US005255525A

United States Patent [19]

Wieland et al.

[11] Patent Number: 5,255,525

[45] Date of Patent: Oct. 26, 1993

[54] SYSTEM AND METHOD FOR ATOMIZATION OF LIQUID METAL

[75] Inventors: Rolf H. Wieland, Norristown; Howard J. Obman, Souderton, both of Pa.; Alan B. Davala, Florence, N.J.

[73] Assignee: MG Industries, Malvern, Pa.

[21] Appl. No.: 890,226

[22] Filed: May 29, 1992

Related U.S. Application Data

[63] Continuation-in-part of Ser. No. 780,924, Oct. 22, 1991, abandoned.

[51] Int. Cl.[5] ..... F17C 11/00

[52] U.S. Cl. ..... 62/46.1; 62/50.2; 62/121; 75/338

[58] Field of Search ..... 62/46.1, 50.1, 50.2, 62/121; 75/338

[56] References Cited

U.S. PATENT DOCUMENTS

| | | | |
|---|---|---|---|
| 3,741,456 | 6/1973 | Smith . | |
| 3,898,853 | 8/1985 | Iung . | |
| 4,275,752 | 6/1981 | Collier et al. . | |
| 4,296,610 | 10/1981 | Davis | 62/50.1 |
| 4,336,689 | 6/1982 | Davis . | |
| 4,430,865 | 2/1984 | Davis | 62/121 |
| 4,570,578 | 2/1986 | Peschka et al. . | |
| 4,585,473 | 4/1986 | Narasimhan et al. | 75/338 |
| 4,615,352 | 10/1986 | Gibot . | |
| 4,715,187 | 12/1987 | Stearns . | |
| 4,909,038 | 3/1990 | Porter . | |
| 4,961,325 | 10/1990 | Halvorson et al. . | |

FOREIGN PATENT DOCUMENTS

| | | | |
|---|---|---|---|
| 170503 | 8/1986 | Japan | 75/338 |
| 130207 | 6/1987 | Japan | 75/338 |
| 8912116 | 12/1989 | World Int. Prop. O. | 75/338 |

*Primary Examiner*—Ronald C. Capossela
*Attorney, Agent, or Firm*—William H. Eilberg

[57] ABSTRACT

The present invention produces a cold gas stream having a constant temperature and pressure. The gas stream is obtained from two initial streams, one being a liquefied gas and the other being a gas at ambient temperature. The liquefied gas stream is combined with the warm gas stream, causing the liquid to vaporize. The two streams are combined in proportions that yield a cold gas mixture having a desired temperature. The resulting cold gas mixture is directed into an insulated container having a volume significantly larger than the volume of the conduits through which the streams flow. The container therefore acts as a buffer to reduce pressure fluctuations in the stream. A temperature equalization coil is located in the interior of the container. The coil has one open end which communicates with the interior region of the container, the other end of the coil being connected to an outlet line. The cold gas in the coil remains within the coil for a relatively long time, and comes into thermal equilibrium with cold gas outside the coil. Thus, temperature variations in the cold gas stream are reduced. The cold gas which is withdrawn from the chamber is essentially constant in both temperature and pressure. The invention also includes the use of the cold gas, produced as described above, to atomize molten metal to form a metal powder.

29 Claims, 1 Drawing Sheet

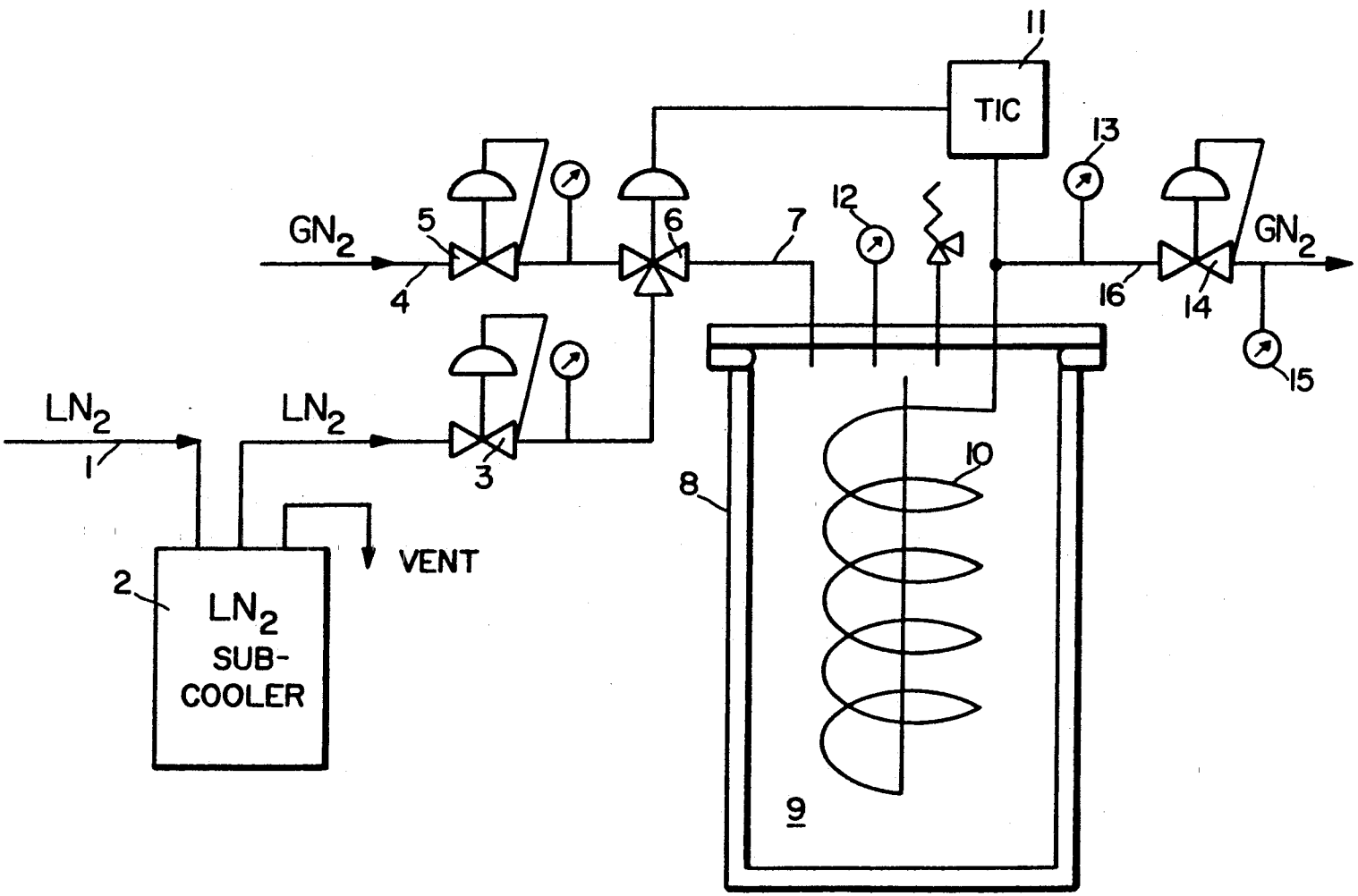
GN2
15
14
16
13
11
TIC
10
12
7
9
8
6
5
4
3
GN2
LN2
VENT
LN2
SUB-
COOLER
2
LN2
1

SYSTEM AND METHOD FOR ATOMIZATION OF LIQUID METAL

CROSS-REFERENCE TO PRIOR APPLICATION

This is a continuation-in-part of U.S. patent application Ser. No. 07/780,924, filed Oct. 22, 1991 now abandoned.

BACKGROUND OF THE INVENTION

This invention relates to the field of atomization of liquid metals, to produce metallic powders. The invention also relates to the field of cryogenic gases, and provides a system and method for producing a stream of cold gas, the temperature and pressure of the stream being very precisely regulated.

Metal powders are useful in various applications. For example, in the manufacture of printed circuit boards, conductive layers are applied to a substrate in the form of metal powder. If the particles of the powder are too coarse, conductors of the circuit pattern may become short-circuited. To maximize the line density, and to increase the efficiency and yield of the manufacturing process, one needs a metal powder having small, fine, spherical particles.

Metal powders are also useful in applying a uniform metallic coating to a surface, such as by flame spraying or welding. As in the case of printed circuit boards, a uniform coating requires small, spherical, and uniform particles.

Still another application of metal powders is in metal injection molding. In this process, metal powder is mixed with a plastic material and is formed into a shaped article, the particles of the powder becoming fused together with the application of heat. Again, the results of this type of process are most favorable when the particles are small, spherical, and uniform.

Metal powders can also be used for other purposes, such as for soldering and sintering.

Methods of making metal powders have been known in the prior art. A metal powder can be made by directing a pressurized gas, at ambient temperature, towards a liquid metal. The liquid metal is atomized by the gas, and cools to form a powder. The gas is preferably inert, or relatively inert, to prevent oxidation of the metal. The preferred gas is nitrogen, which remains substantially inert throughout a wide range of temperatures.

It has also been known to use a cryogenic liquid, instead of a gas, as the agent which atomizes the liquid metal.

The present invention uses a cold gas to atomize the liquid metal, to form a metal powder. A major problem with such use of cold gas is in the need to control accurately the pressure and temperature of the gas. Such control is necessary to allow precise control of the distribution of particle sizes, and to control the configuration of the particles. It has been found necessary that the pressure fluctuations be less than about 1 psi, and the temperature fluctuations should be less than about ±2° F.

Although cryogenic fluid delivery systems have been known for a long time, it has proven difficult to provide a cold gas stream having the above degree of consistency. Examples of dispensing systems of the prior art are shown in U.S. Pat. Nos. 4,909,038, 4,715,187, 4,336,689, 4,961,325, and 4,570,578. Other systems of the prior art include heaters which vaporize specific volumes of liquefied gas, and which use additional trim heaters to achieve desired gas temperatures. None of the above-mentioned systems provides the precision of control of temperature and pressure required in the liquid metal atomization process.

Another problem in the production of metal powders is the appearance of multiple "phases". That is, when a two-component alloy is melted and then slowly cooled, one component may solidify first, causing localized regions of increased concentration of that component. The separated components may manifest themselves as streaks, or dendrites, in the particles of the finished powder. This effect makes the particles less spherical and less homogeneous, and should therefore be minimized.

The present invention solves the above-described problems by providing an apparatus and method which produces a consistent cold gas stream, and which can be used to atomize liquid metals. The apparatus is simple, economical, and reliable, and provides a stream of gas which fulfills the temperature and pressure criteria specified above. The invention is not limited to use in liquid metal atomization, but can be used in any system or process which requires a consistent cold gas stream.

SUMMARY OF THE INVENTION

According to the present invention, a cold gas stream is used to atomize a liquid metal, thereby producing metal particles forming a powder. The cold gas not only atomizes the liquid metal, but also cools the resulting metal particles, and yields a clean and shiny powder. The metal particles are cooled very rapidly by the cold gas, and the result is a very fine and uniform powder. The above-described method also has a high throughput rate.

The invention also includes a method and apparatus for producing the cold gas stream. This cold gas stream originates from two separate streams, one cold and one relatively warm. The cold stream is preferably obtained by subcooling a liquefied gas stream to obtain a liquid having a constant temperature of −320° F., regardless of its pressure. The warm gas stream is at ambient temperature. The cold and warm streams are passed through pressure regulators, so that they have the same pressure. When the cold and warm streams are combined, the liquid stream vaporizes. The initial liquid gas stream and warm gas streams are combined in proportions chosen such that the combined cold gas stream has a desired temperature.

The combined stream then passes into an insulated container. The container defines an interior region having a volume significantly greater than the volume of the conduits leading to the chamber. Thus, the container acts as a buffer to reduce fluctuations in gas pressure.

Disposed within the container is a finned-tube heat exchanger coil, through which the gas stream passes. One end of the coil opens to the interior of the container, the other end of the coil being connected to an outlet line. If the coil is sufficiently long, the gas flowing through the coil comes into temperature equilibrium with the gas in the interior of the container. Thus, the gas appearing at the outlet line has an essentially constant temperature. The gas at the outlet line also has a constant pressure, due to the buffering effect of the chamber. The temperature of the output stream can be varied by adjusting the proportions of the initial cold and warm gas streams used to make the mixture.

It is therefore an object of the present invention to provide an improved method and apparatus for making metal powders.

It is another object of the present invention to provide a system and method of providing a consistent cold gas stream, such as can be used to atomize liquid metals.

It is another object to provide a cold gas stream in which the pressure variations in the stream are not more than about 1 psi, and wherein the temperature fluctuations are less than about ±2° F.

It is another object to provide a cold gas stream, the temperature of which can be determined in advance.

It is another object to produce a consistent cold gas stream in an efficient and economical manner.

It is another object to enhance the efficiency and reliability of a liquid metal atomization process, so as to produce metal powders having particles of desired size and uniformity.

It is another object to provide a cold gas stream which originates from two separate streams, one in gaseous form and one in liquid form.

Other objects and advantages of the invention will be apparent to those skilled in the art, from a reading of the following brief description of the drawing, the detailed description of the invention, and the appended claims.

BRIEF DESCRIPTION OF THE DRAWING

The FIGURE is a schematic diagram showing the system made according to the present invention.

DETAILED DESCRIPTION OF THE INVENTION

The present invention is a system and method for producing a metal powder. The invention also includes an apparatus and method for providing a consistent cold gas stream, which can be used to atomize a liquid metal. The gas stream is typically nitrogen, and the invention will be described with respect to nitrogen. However, it is understood that other gases, especially inert or relatively inert gases, could be used instead of nitrogen, according to the same principles.

As used herein, the term "cold gas" means a gas whose temperature is lower than ambient temperature, but higher than the temperature at which the gas becomes a liquid. When used for atomizing a molten metal, the temperature range of interest lies between about −50° F. and about −250° F., but the term "cold gas" is intended to include the broader definition given above.

In the FIGURE, liquid nitrogen is provided from a tank (not shown) and is conveyed, through conduit 1, into subcooler 2. The liquid nitrogen is cooled, in the subcooler, to a temperature of −320° F., regardless of the inlet pressure. The subcooled liquid nitrogen then passes to pressure regulator 3.

The subcooler can be constructed according to the teachings of U.S. Pat. No. 4,510,760, entitled "Compact Integrated Gas Phase Separator and Subcooler and Process", the disclosure of which is incorporated by reference herein. Other subcooler structures can also be used. Also, one can practice the invention without a subcooler. However, use of the subcooler is preferred because it produces a liquid nitrogen stream which is consistent in temperature, regardless of liquid pressure, and because it eliminates all gaseous components from the liquid supply.

Meanwhile, a source (not shown) of gaseous nitrogen, preferably at ambient temperature, is connected to supply conduit 4. The gaseous nitrogen passes through pressure regulator 5. Pressure regulators 3 and 5 are set such that the pressure in the gaseous line 4 equals the pressure in the liquid line. The liquid and gas streams are applied to three-way proportional control valve 6, in which the streams are blended, in a desired ratio, to produce a cold gas having a desired predetermined temperature. Thus, the liquid nitrogen is vaporized in valve 6, when the liquid is mixed with the warm gas, to produce a cold gas in conduit 7.

The cold gas mixture then passes, through conduit 7, to a vacuum-insulated surge vessel 8. The vessel defines an interior region 9 which acts as a pressure surge buffering chamber, and which is sufficiently insulated so that heat does not infiltrate into the cold gas stream. The pressure in region 9 is monitored by gauge 12. The volume of region 9 is significantly larger than the effective volume of the conduits leading from the sources of liquid and gaseous nitrogen. As illustrated in the FIGURE, the volume of region 9 is at least one order of magnitude, and preferably several orders of magnitude, greater than the effective volume of the conduits. Due to this difference in volume, pressure fluctuations in the line are damped by the greater volume of gas in the chamber, and the pressure of the gas in the chamber therefore remains substantially constant.

The cold gas in the chamber passes through temperature equalization coil 10. As shown in the FIGURE, one end of the coil is open to region 9, i.e. the interior of the coil is fluidly connected to the interior of the chamber. The coil is connected to outlet line 16. Gauge 13 measures the pressure of the gas leaving the vessel, and pressure regulator 14 can be used to reduce the pressure further, if necessary, to the level required for a specific application. The final output pressure can be monitored with gauge 15.

The coil is preferably of sufficient length to allow the cold gas within the coil to come into thermal equilibrium with the interior region 9, but not so long as to create an appreciable pressure drop within the coil. Because the cold gas in the coil is made to come into thermal equilibrium with the cold gas outside the coil, in region 9, the temperature of the cold gas in the coil is very stable. Thus, the temperature of the cold gas leaving the coil, through outlet line 16, is also essentially constant.

Coil 10 is preferably constructed as a finned-tube heat exchanger, but it can also assume other forms. In general, it is necessary only that the gas in the chamber pass through an elongated conduit, disposed within the chamber, so that the gas can come into thermal equilibrium with the gas in the region outside the conduit.

The temperature of the cold gas stream is regulated by temperature controller 11 and control valve 6. Controller 11 is connected to outlet line 16, and monitors the temperature of the gas in the line. In response to changes in the temperature of the cold gas stream, controller 11 adjusts the setting of valve 6, to change the proportion of liquid and gaseous nitrogen components in the original mixture. If the temperature in line 16 is too high, controller 11 causes valve 6 to admit more liquid nitrogen from subcooler 2. If the temperature in line 16 is too low, controller 11 causes valve 6 to reduce the amount of liquid nitrogen from subcooler 2.

The cold gas which is withdrawn from line 16 is therefore consistent in both pressure and temperature, and is substantially free of surges of pressure, temperature, or flow rate.

The present invention also includes a method for making a metal powder. According to this method, one directs a stream of cold gas through an atomizing nozzle and towards a stream of liquid metal, thereby atomizing and cooling the liquid metal, and producing the metal powder. In the preferred embodiment, one obtains the cold gas stream from the apparatus described above. The resulting metal powder contains small, fine, spherical particles. The powder is substantially homogeneous, and free of multiple phases, described above.

In practicing the above-described method for making a lead solder powder, for example, experiments have produced optimum results when the temperature of the cold gas entering the nozzle is in the range of about −140° F. to about −200° F., with the preferred temperature being about −150° F., and when the pressure of the cold gas is in the range of about 30–40 psig. The lower the pressure, the greater the percentage of larger particles in the resulting powder. Conversely, higher pressures produce a greater percentage of smaller particles. Thus, the pressure directly affects the size distribution of particles in the powder. Powders having predominantly large particles and powders having mainly small particles both have utility, in varying applications.

The apparatus used for performing the atomization is essentially similar to that used in prior art atomization processes. The only major differences are that in the present invention, one may need to insulate the conduit carrying cold gas to the atomizing nozzle, and that one must physically separate the equipment for cooling the atomizing gas from the equipment which melts the metal to be atomized. It is an important feature of the present invention that one can achieve superior results by passing a cold gas, as defined above, through a conventional atomizing nozzle.

While the invention has been described with respect to the particular embodiment shown in the FIGURE, it is understood that the physical arrangement may be modified, within the scope of the invention. The initial sources of liquid and gas can be varied, as can the shape of the pressure surge chamber and temperature equalization coil. The arrangement of valves and gauges can be varied. As noted above, the invention can be practiced with gases other than nitrogen. Also, it is intended that the gas in conduit 4 be the same substance as the liquid in conduit 1 (such as nitrogen), but it is possible to use different substances in these different conduits. These and other similar modifications should be considered within the spirit and scope of the following claims.

What is claimed is:

1. A method of producing a cold gas, the method comprising the steps of:

a) providing a first stream of liquefied gas, b) providing a second stream of warm gas, the first and second streams having the same pressure, c) mixing said first and second streams in relative amounts sufficient to vaporize the first stream, and to produce a third stream which comprises a gas having a desired temperature, d) directing said third stream into an insulated chamber, the chamber having an interior region, e) directing said third stream into a coil disposed within the chamber, the coil being fluidly connected to the interior region of the chamber, the coil also being fluidly connected to an outlet line, and f) withdrawing said third stream from said outlet line.

2. The method of claim 1, wherein step (a) includes the step of subcooling the first stream.

3. The method of claim 1, wherein the warm gas in step (b) is at ambient temperature.

4. The method of claim 1, wherein said first and second streams are passed through pressure regulating valves before the streams are mixed with each other.

5. The method of claim 1, further comprising the steps of monitoring the temperature of the gas stream in the outlet line, and continuously adjusting the proportions of said first and second streams, in step (c), in response to the monitored temperature, such that the gas in the outlet line has a desired temperature.

6. A method of making a metal powder, comprising the steps of providing a metal in molten form, and directing a stream of cold gas towards the molten metal so as to atomize the molten metal, the cold gas being produced according to the method of claim 5.

7. The method of claim 6, wherein the cold gas has a temperature in the range of about −50° F. to about −250° F.

8. The method of claim 1, wherein the interior region of the chamber has a volume sufficient to reduce fluctuations in pressure of the gas in the chamber.

9. A method of making a metal powder, comprising the steps of providing a metal in molten form, and directing a stream of cold gas towards the molten metal so as to atomize the molten metal, the cold gas being produced according to the method of claim 1.

10. A method of producing a cold gas, the method comprising the steps of:

a) combining a liquefied gas with a warm gas, to produce a cold gas mixture, the liquefied gas and the warm gas being combined in proportions selected such that the cold gas mixture has a desired temperature, b) directing the cold gas mixture into an insulated container, the container defining an interior region having a volume sufficient to eliminate substantially all fluctuations in pressure of the cold gas mixture, c) passing the cold gas mixture through an elongated conduit, the conduit being disposed within the interior region of the container, and d) withdrawing the cold gas mixture from the conduit.

11. The method of claim 10, wherein the elongated conduit comprises a coil having one end which is fluidly connected with the interior region of the container.

12. A method of making a metal powder, comprising the steps of providing a metal in molten form, and directing a stream of cold gas towards the molten metal so as to atomize the molten metal, the cold gas being produced according to the method of claim 14.

13. The method of claim 12, wherein the cold gas has a temperature in the range of about −50° F. to about −250° F.

14. The method of claim 10, further comprising the steps of monitoring the temperature of the cold gas mixture being withdrawn from the conduit, and continuously adjusting the proportions of the liquefied gas and the warm gas, in step (a), in response to the monitored temperature, such that the cold gas mixture being withdrawn from the conduit has a desired temperature.

15. The method of claim 10, wherein the liquefied gas is obtained from a subcooler.

16. The method of claim 10, wherein the liquefied gas and the warm bas in step (a) are passed through pressure regulators before being combined, such that the pressures of the liquefied gas and the warm gas are substantially equal before they are combined.

17. The method of claim 10, wherein the directing step comprises directing the cold gas mixture through a supply conduit having a volume, and wherein the volume of the interior region of the container is at least one order of magnitude larger than the volume of the supply conduit.

18. A method of making a metal powder, comprising the steps of providing a metal in molten form, and directing a stream of cold gas towards the molten metal so as to atomize the molten metal, the cold gas being produced according to the method of claim 10.

19. Apparatus for producing a consistent cold stream of gas, comprising:

a) means for providing a first stream of liquefied gas, b) means for providing a second stream of warm gas, c) means for combining said first and second streams, in relative amounts sufficient to produce a cold gas mixture having a desired temperature, and d) means for directing said cold gas mixture into a chamber, the chamber having an interior region, wherein the chamber has an elongated conduit disposed in the interior region of the chamber, the conduit being fluidly connected to the interior region of the chamber and also being fluidly connected to an outlet line.

20. The apparatus of claim 19, wherein the elongated conduit comprises a coil.

21. The apparatus of claim 19, further comprising means for equalizing the pressures of said first and second streams, before these streams are combined.

22. The apparatus of claim 19, wherein the means for providing the first stream includes means for subcooling the first stream.

23. The apparatus of claim 22, wherein the liquefied gas is nitrogen, and wherein the liquefied gas is taken from the subcooling means at a temperature of −320° F.

24. The apparatus of claim 19, further comprising means for monitoring the temperature of the cold gas mixture in the outlet line, and means for continuously adjusting the proportions of the first and second streams in response to the monitored temperature, such that the cold gas mixture being withdrawn from the outlet line has a desired temperature.

25. A method of making a metal powder, comprising the steps of providing a metal in molten form, and directing a stream of cold gas towards the molten metal so as to atomize the molten metal, wherein the molten metal is both atomized and cooled by the same cold gas.

26. The method of claim 25, wherein the cold gas has a temperature in the range of about −50° F. to about −250° F.

27. The method of claim 26, wherein the cold gas has a temperature in the range of about −140° F. to about −200° F.

28. The method of claim 25, wherein the cold gas has a pressure of about 30–40 psig.

29. The method of claim 25, wherein the gas is a relatively inert gas.

* * * * *